United States Patent [19]

Wehrley

[11] Patent Number: 5,056,798

[45] Date of Patent: Oct. 15, 1991

[54] FREEWAY FRENZY

[76] Inventor: H. Bernice Wehrley, 323 S. Barnwell St., Oceanside, Calif. 92054

[21] Appl. No.: 574,753

[22] Filed: Aug. 29, 1990

Related U.S. Application Data

[63] Continuation-in-part of Ser. No. 422,045, Oct. 16, 1989, abandoned.

[51] Int. Cl.[5] ..... A63F 9/00

[52] U.S. Cl. ..... 273/460

[58] Field of Search ..... 273/360, 138 A, 139, 273/237, 240, 269, 270; 434/201, 327, 335; 377/5

[56] References Cited

U.S. PATENT DOCUMENTS

| | | | |
|---|---|---|---|
| 2,000,369 | 5/1975 | Zeiss | 273/240 X |
| 4,312,511 | 1/1982 | Jullien | 273/237 |
| 4,332,389 | 6/1982 | Loyd, Jr. et al. | 273/237 |
| 4,378,940 | 4/1983 | Gluz et al. | 273/269 X |
| 4,438,932 | 3/1984 | Finkel | 273/237 |
| 4,651,995 | 3/1987 | Henkel | 273/237 |
| 4,661,906 | 4/1987 | Di Francesco | 273/237 X |

*Primary Examiner*—William H. Grieb

*Attorney, Agent, or Firm*—Nydegger & Associates

[57] ABSTRACT

An electronic hand-held game apparatus comprises a portable hand-held type computer including a keyboard, display screen, and memory. The keyboard has a plurality of data entry keys and instruction keys. The data entry keys include twenty-six alphabetic and ten numeric characters arranged in a novel manner. In play mode, the microprocessor which controls the data flow between the memory, data entry keys, function keys, and the display, accepts sets of data entered into the keyboard by the player. The sets of data comprise combinations of alphanumeric characters corresponding to license plates observed by the player. The microprocessor compares the license plate data to the stored thirty-six character data to identify and accumulate matches between them. Once all thirty-six characters have been matched, a winning signal is provided. The game is designed so that it may be played with as many players as have the apparatus. Each player takes a turn entering license plate numbers in their own instrument. The first player to have matches for all thirty-six alphanumeric characters is the winner. The instrument provides a win indicator signal.

21 Claims, 4 Drawing Sheets

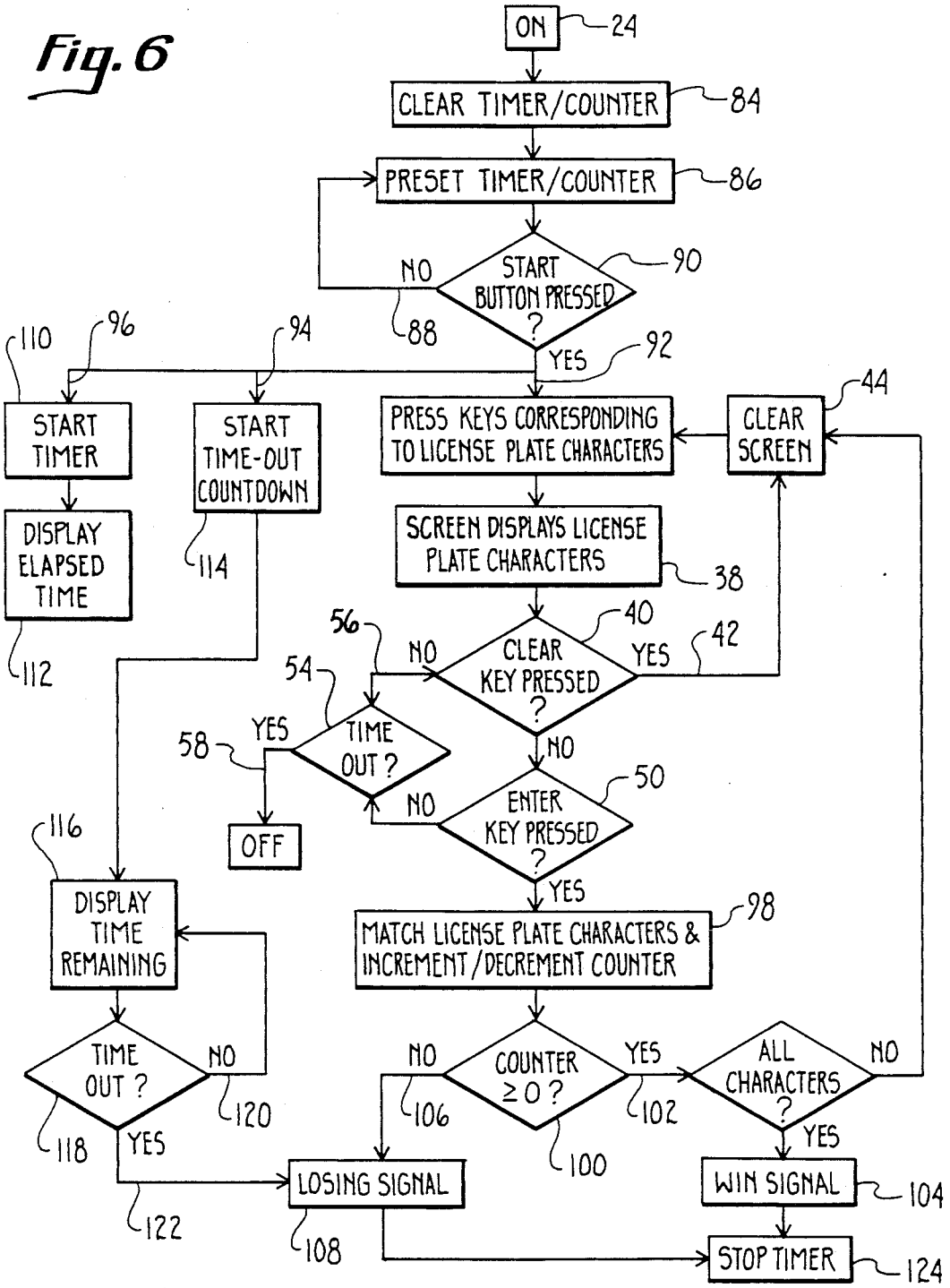
Fig. 6
ON
24
CLEAR TIMER/COUNTER
84
PRESET TIMER/COUNTER
86
START BUTTON PRESSED ?
90
NO
88
YES
92
110
96
94
START TIMER
START TIME-OUT COUNTDOWN
PRESS KEYS CORRESPONDING TO LICENSE PLATE CHARACTERS
CLEAR SCREEN
44
DISPLAY ELAPSED TIME
114
SCREEN DISPLAYS LICENSE PLATE CHARACTERS
38
112
56
40
CLEAR KEY PRESSED ?
NO
YES
42
54
TIME OUT ?
YES
58
NO
OFF
ENTER KEY PRESSED ?
50
NO
YES
116
DISPLAY TIME REMAINING
MATCH LICENSE PLATE CHARACTERS & INCREMENT/DECREMENT COUNTER
98
TIME OUT ?
NO
120
118
YES
122
COUNTER ≥ 0 ?
NO
106
YES
102
100
ALL CHARACTERS ?
NO
YES
LOSING SIGNAL
108
WIN SIGNAL
104
STOP TIMER
124

FREEWAY FRENZY

FIELD OF THE INVENTION

This application is a continuation-in-part of prior co-pending application Ser. No. 422,045, filed Oct. 16, 1989 now abandoned.

This invention relates generally to games. More specifically, the invention relates to a hand-held portable electronic game having an objective of matching sets of combinations of characters to characters electronically stored in the device. The present invention is particularly, though not exclusively, useful for a freeway number game played by one or more individuals while traveling in an automobile.

BACKGROUND OF THE INVENTION

There are a number of known games of chance in which players attempt to match predetermined alphabetic and/or numeric characters to a randomly generated sample of similar characters. Such devices have various mechanisms or methodologies for selecting the randomly-generated characters. For example, the well known game of bingo includes removing a marked ball from a container to obtain the characters to be matched. Over the years there have been other changes to the game of bingo which include different ways of generating random numbers, which are then matched against the particular predetermined layout of a bingo card. However, such gaming apparatus for matching such selected sets of characters necessarily include various additional components to generate the random numbers. These include, in addition to marked balls, such things as arrows spinning on a dial, dice, computerized random number generators, and the like.

In addition, improvements have been made in taking the bingo card-type approach to the game and computerizing it, and directing it to a hand-held portable-type device. With the advent of microcomputer technology, many of the features can be programmed relatively inexpensively into an electronic, hand-held bingo-type game. However, even with such portability, such electronic bingo-type number matching games do not address the issue of providing an interesting and diverting challenge to the player.

Games offering interesting diversions are even more in demand at present. As more and more areas become urbanized, and the population generally increases, there is more automobile traffic on the roads. Many people find themselves spending substantial amounts of time traveling in a motor vehicle. This is especially the case on highways and freeways in large metropolitan areas. Often times, particularly at rush hour, traffic congestion is so intense that the normal highway speeds are reduced to stop-and-go movement, speeds averaging less than five (5) miles per hour. A driver and passengers in a vehicle can be delayed for long periods of time in such traffic congestion. Various diversions are available to such detained drivers and passengers in an automobile including a car radio, car telephones, and the like. In addition, various games have been devised which can conveniently be played in an automobile to help pass the time while traveling. Unlike a conventional bingo game in which the particular card layout changes from game to game and thus affects the chances of winning, the present invention's outcome is only affected by the randomness associated with different license plates.

The present invention thus recognizes the need to make the best of such situations, and to conveniently use information or knowledge gained during such travel to form the subject of a number match game. The present invention further recognizes the need for a novel game design to be played while traveling in an automobile.

Accordingly, it is an object of the present invention to provide a hand-held electronic game apparatus which uses information readily perceivable from a traveling automobile. It is yet another object of the present invention to provide a game apparatus which is stimulating and helps prevent boredom while traveling in an automobile. It is yet another object of the present invention to provide an electronic number match game which is portable and easy and convenient to utilize. It is yet another object of the present invention to provide a number match game apparatus which is durable and reliable in operation. It is yet another object of the present invention to provide a number match game apparatus which is cost-efficient to manufacture and convenient to use.

SUMMARY OF THE INVENTION

A preferred embodiment of the electronic game apparatus comprises a hand-held portable computer which includes a keyboard, and a screen display. The keyboard has a plurality of data entry keys and instruction keys. The data keys include twenty-six (26) alphabetic and ten (10) numeric keys for entering data. The entered alphanumeric character information is displayed on a screen. A microprocessor is also housed in the hand-held portable computer and includes a memory for storing character data corresponding to the thirty-six (36) data entry keys. This stored character data remains constant from game to subsequent game providing an identical set of characters to be matched throughout. The microprocessor controls the flow of data between the data entry keys, the display, and the memory. In play mode, the microprocessor accepts sets of data entered by the user via the data entry keys. The sets of data entered are comprised of a combination of alphanumeric characters, each set corresponding to either a license plate observed by the player or to one of a set of playing cards provided with the game apparatus. The microprocessor compares each set of entered license plate data to the stored thirty-six (36) character data. Any matches between the entered data and the stored thirty-six (36) character data are identified and accumulated by the microprocessor. When all thirty-six (36) stored characters have been matched, the microprocessor provides a win signal.

Additionally, the present invention employs a clock timer on the front panel layout which can function as a stopwatch enabling the player to play against the clock in an effort to win the game in the shortest amount of time. Besides acting as a stopwatch, the player can also preset the timer to a specific time period and then try to win the game before the timer reaches zero.

Furthermore, the present invention incorporates an incremental counter for displaying the number of license plates or playing cards used to win the game. In this manner, the player attempts to finish the game using the smallest number of license plates or cards. Also, the counter could be preset to represent a specific number of data sets, which then decrements by one each time a set of data is entered by depressing the appropriate key. The player would then win only by matching all thirty-six (36) numbers before the counter reaches a value less than zero.

The microprocessor may be powered by a solar battery. Instruction keys may include an on/off key, enter key, and clear key. In a preferred embodiment, the thirty-six (36) alphanumeric keys are arranged in four rows and nine (9) columns, with the first row comprising the characters "J, 4, B, 6, V, 1, K, U, G"; the second row comprising the character "D, W, E, H, R, L, Y, N, M"; the third row comprising the characters "3, S, C, O, T, I, 9, 7, 0"; and the fourth row comprising the characters "F, P, A, 5, X, Z, Q, 8, 2". The novel features of this invention, as well as the invention itself, both as to its structure and its operation, will be best understood from the accompanying drawings, taken in conjunction with the accompanying description, in which similar reference characters refer to similar parts, and in which:

BRIEF DESCRIPTION OF THE DRAWINGS

FIG. 6 is a schematic flow-chart diagram showing the methodology and structure of the alternative game apparatus containing a timer and a counter.

DETAILED DESCRIPTION OF THE PREFERRED EMBODIMENT

Figure 1:
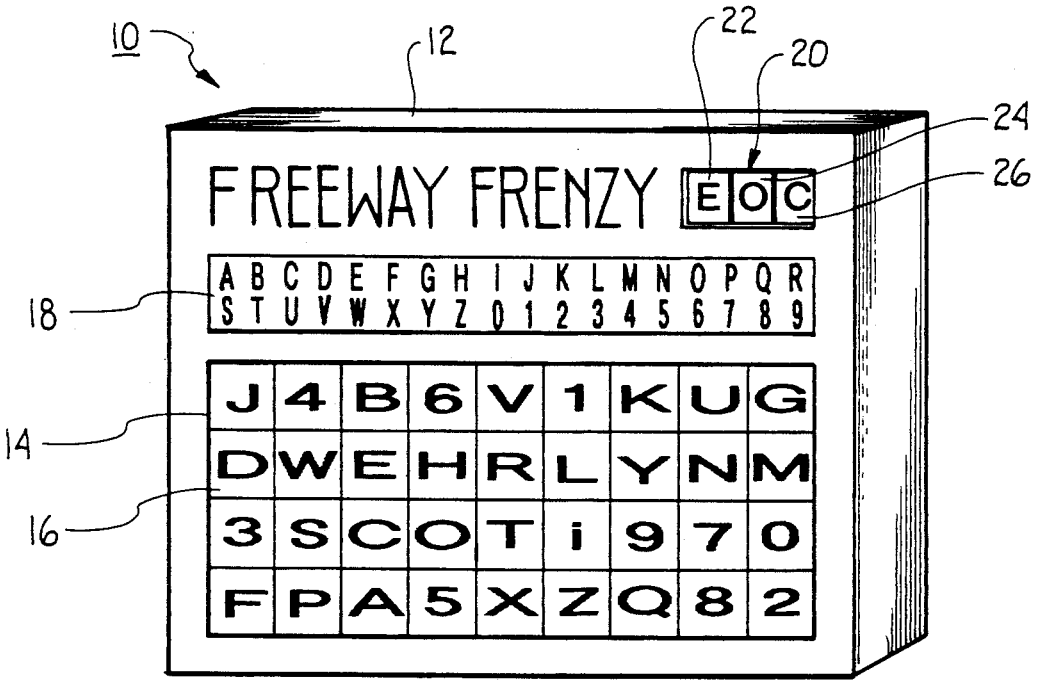
FIG. 1 is a perspective view of a preferred embodiment of the electronic game apparatus in accordance with the present invention.

Referring now to FIG. 1, there is shown the portable electronic game apparatus of the present invention generally designated 10. Game apparatus 10 comprises casing 12 which houses a keyboard 14. Keyboard 14 has a series of alphanumeric data entry keys generally designated 16. Casing 12 further includes a display screen 18. In the embodiment shown, display screen 18 includes a series of letters and numerals which correspond to the alphanumeric characters on data entry key 16. As shown in FIG. 1, data entry keys 16 each correspond to an alphabetic or numeric character. In the preferred embodiment shown, there are four (4) rows and nine (9) columns of alphanumeric characters arranged on the keyboard. The particular arrangement of the characters and keys is such that it provides an interesting and novel manner of displaying the data entry keys.

Moreover, display screen 18 has a series of alphanumeric characters which can be activated to become readily visible. The screen characters correspond to at least each one of the alphanumeric data entry keys 16. Also mounted on casing 12 are function keys generally designated 20. In the embodiment shown in FIG. 1, there are three (3) function keys 20 which correspond to an enter key 22, an on/off key 24, and a clear key 26.

Casing 12 is preferably of a size which is that of a hand-held portable calculator. In addition, the material utilized for casing 12 is a durable and reliable material typically found and used for calculators such as durable plastic, which may be injection molded.

The display screen 18 may be any standard calculator-type display screen. Suitable displays include liquid crystal displays which utilize little power and provide necessary resolution for providing a clear and distinct display of the alphanumeric information.

The data entry keys 16 are standard size data entry keys which are easily depressible by the user of the apparatus 10. In addition, it may readily be seen that the alphabetic characters include the twenty-six (26) letters of the alphabet, and the numeric characters include the digits "0" through "9". Thus, there are thirty-six (36) alphanumeric characters available on the data entry keys 16 of the keyboard 14, and the same thirty-six (36) alphanumeric characters which are displayable on display screen 18.

Figure 2:
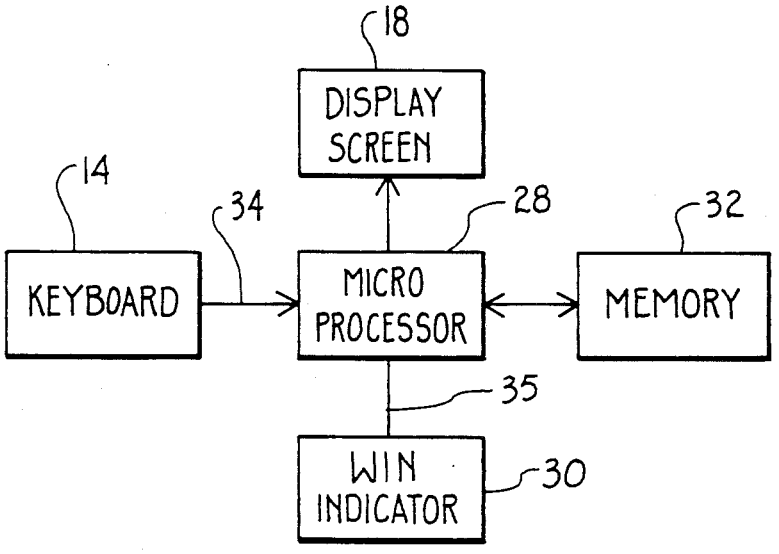
FIG. 2 is a block diagram illustrating the operation of the portable electronic game apparatus of FIG. 1.

Referring now to FIG. 2, there is shown a block diagram of the components of the apparatus 10. In particular, casing 12 houses a microprocessor computer 28. Microprocessor 28 is operably connected to keyboard 14 and display screen 18 for controlling flow of information between them. In addition, the microprocessor 28 is connected to a win indicator 30. Microprocessor 28 and win indicator 30 may be carried inside casing 12 and therefore are not shown in FIG. 1. In addition, microprocessor 28 is operably connected to a memory 32, also operably mounted in casing 12. Memory 32 includes a permanent memory portion as well as a variable memory portion. In the permanent memory portion, characters of the alphabet "a" through "z", and numeric digits "0" through "9" are stored. There is also stored in memory a data flag field which indicates which of the characters stored in fixed memory have been matched during operation of the system as further described below.

Microprocessor 28 accepts input data 34 entered by the player of the game, via keyboard 14. The data entered is accepted by microprocessor 28 and displayed on display screen 18. As earlier stated, when the player wins the game, a win signal 35 is generated for activating the win indicator 30 as will be further described below.

Figure 3:
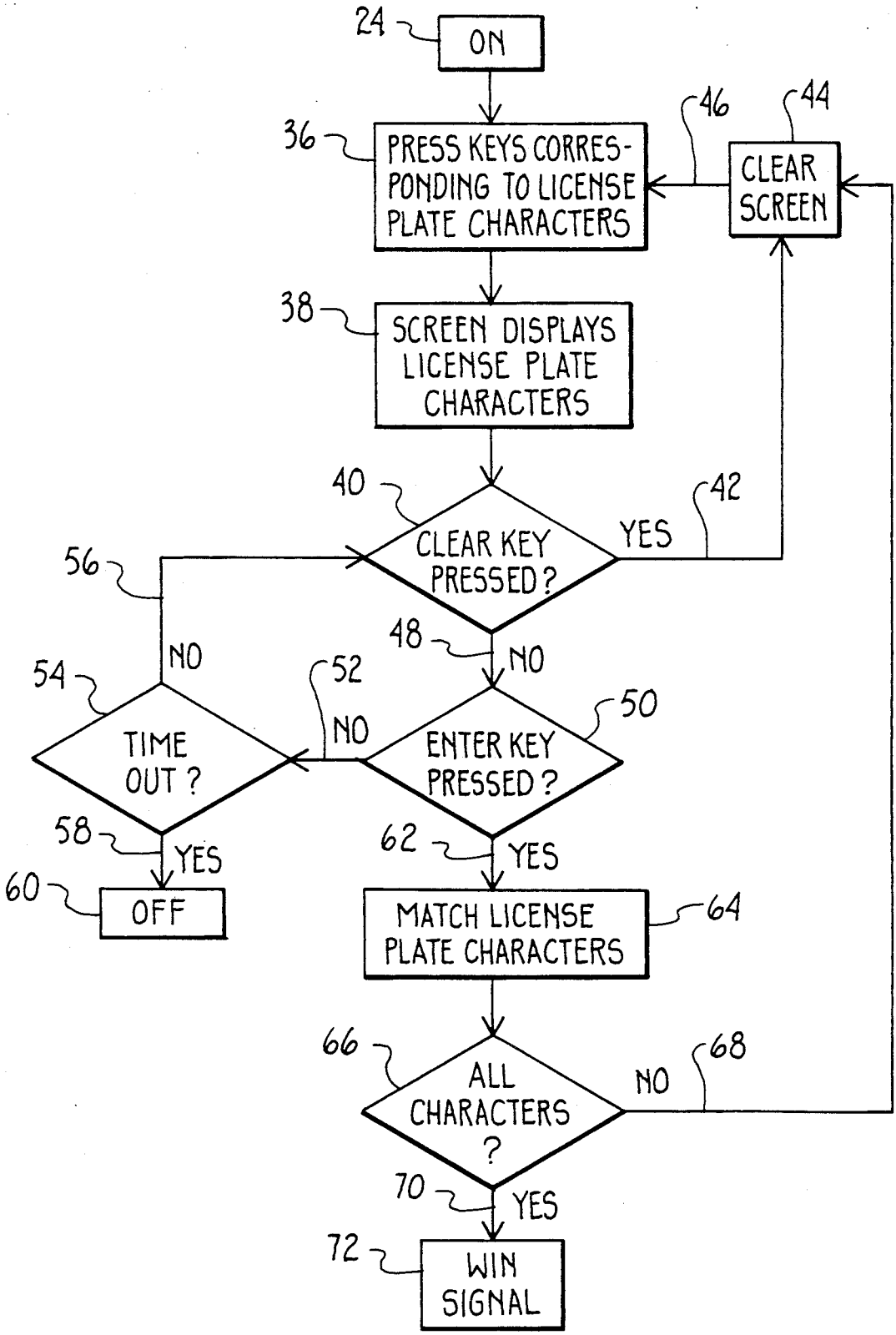
FIG. 3 is a schematic diagram showing the methodology and structure of the game apparatus in accordance with the present invention.

Referring now to FIG. 3, there is shown a block diagram of the schematic illustration of the operation of the system and method of the present game apparatus 10. In particular, the user or player activates the apparatus 10 by pressing "on" button 24. The player then presses data entry keys 16 in accordance With the teachings of the present invention. For example, in traffic congestion, or on long trips when the player is traveling in an automobile, a number of license plates come into view. In particular, many times in waiting traffic, the license plates coming into view may be about the only interesting changes in the scenery. Most license plates are generally comprised of a series of numerals and letters, typically up to eight characters for each license plate. A player picks a license plate and presses keys according to the license plate to enter the characters, i.e. numerals and letters, for that particular license plate into the apparatus 10 via data entry keys 16.

As the keys are pressed corresponding to the license plate numbers as indicated by block 36, the screen 18 displays the license plate characters as they are entered, as indicated by block 38. As each license plate character is entered, the system flow checks at test block 40 as to whether clear key 26 has been depressed by the player. This clear key 26 allows a player to correct an error made in entry of the license plate characters. In the event the clear key 26 is pressed as indicated by the yes branch 42, the system flow is directed to the clear screen block 44. This causes the screen 18 to be cleared so that all of the characters which were previously displayed are erased and the system flow returns by flow link 46 back to press key block 36. The player can then correctly press the corresponding keys 16 to again enter license plate characters. In the event the series or set of license plate characters, which represents a combination of alphanumeric characters, is correct, the clear key test block 40 is answered no 48. This causes the system flow to inquire at test block 50 as to whether enter key 22 has been pressed by the player. In the event it has not been pressed, the system travels via the no path 52 to a time-out test block 54. Time-out test block 54 increments a clock (not shown). If the accumulation of time has not surpassed the time-out limit (e.g. 30 seconds), the system flow is directed via loop 56 back to test block 40. The system is then again directed to flow via link 48 to the enter key test block 50. Again, if the enter key 22 has not been depressed, the system continues to flow via no path 52 to time-out test block 54 and back through feedback loop 56.

After some period of time, if the time-out feature is surpassed, the time-out test block 54 detects this and directs the system logic via yes path 58 and turns the system off 60. In the event enter key test block 50 is answered yes, meaning that the player has pressed the enter key 22 indicating that the license plate characters previously pressed into the keyboard are correct, the system flows via yes path 62 to block 64. Block 64 stores the set of license plate characters in a temporary memory portion of memory 32. Block 64 stores in its data flag field which of the 36 characters stored in fixed memory are matched by the characters from the set of entered license plate characters. Thus, in block 64 there is a comparison of each set of license plate characters to all thirty-six (36) characters and also an update of the characters which are matched. The system flow then moves to test block 66. In test block 66, there is a test as to whether all thirty-six (36) characters have yet been matched. In the event that they have not, the system flows via no path 68 back to clear screen block 44, and on to press key block 36. The system is thus ready for entry of the next license plate character combination.

Figure 7:
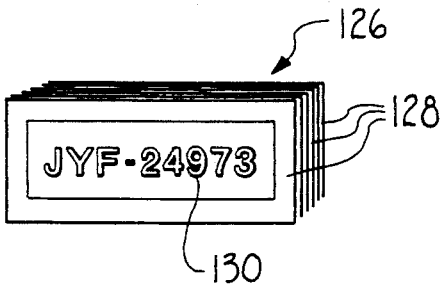
FIG. 7 is a perspective view of a deck of playing cards depicting license plate characters.

The above process is repeated a number of times for each license plate spotted by the player. Eventually, all characters will have been matched. In this event, the test block 66 is answered yes 70 in which case the logic proceeds to win indicating step 72. This corresponds to a win signal 35 sent to win indicator 30 as shown in FIG. 7. Thus, as each license plate is entered by the player, the system automatically stores and updates the number of matches of characters.

In playing the game with others, the game apparatus of the present invention can be played with as many players as have instruments. Typically, the passengers in an automobile would each have their own apparatus 10. Each player takes a turn, and types in a combination of alphanumeric characters corresponding to the license plate of a motor vehicle in view. The first player to type in, and match all thirty-six (36) digits, is the winner. The instrument will then give a win signal. The instrument preferably has some indicator, such as a blinking red light, or the screen flashing the word "WINNER", or the like. In addition, the system may include as win indicator 30, an audible alarm which can sound an audible beep, or comprise a voice synthesizer which preferably makes the voice-synthesized words "you win".

Figure 4:
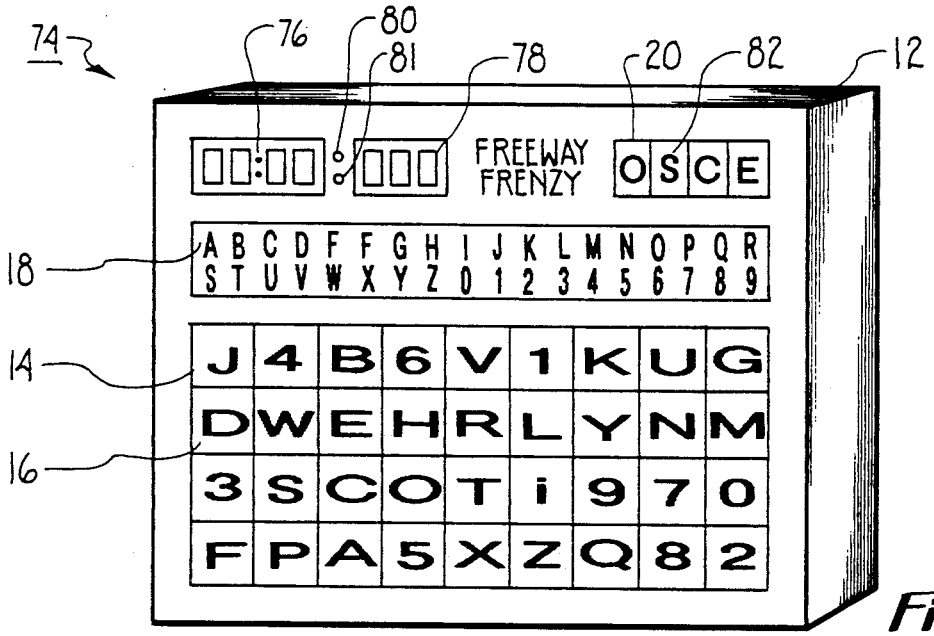
FIG. 4 is a perspective view of the electronic game apparatus incorporating the electronic timer and the license plate counter.

Additionally, the game may be enjoyed by either several or only one player by taking advantage of the features employed in an alternative embodiment of the game apparatus. An alternative embodiment of the present invention incorporates a timer and a counter within the electronic apparatus for comparing the relative performance between separate attempts to win the game. FIG. 4 depicts the alternative embodiment of the game apparatus generally designated 74. The front panel of the game is similar to that of the preferred embodiment and incorporates a display screen 18, a keyboard 14, and function keys 20. However, in addition to the preferred embodiment, FIG. 4 depicts the game apparatus with the electronic timer 76 and electronic counter 78. The timer 76 and counter 78 can each operate in one of two methods.

The first method entails presetting either the timer 76 or counter 78 by respectively depressing either button 80 or button 81. In this manner a specific time period, or a specific number of license plates, is stored in memory that will decrement upon pressing the start key 82. If all thirty-six (36) numbers have not been matched before either the timer or counter reaches zero, then the game interrupts play with a "losing" signal.

The second method merely keeps track of the time elapsed and the number of license plates used to win the game. To play the game in this second manner, the player merely turns the apparatus on and depresses the start button without using the preset buttons 80 or 81. When the start button is pressed while the timer and counter displays read zero, they will both increment accordingly.

Furthermore, in accordance with the present invention, it is to be understood that only one of the mechanisms 76 and 78 need be preset, which would then result in one mechanism incrementing and the other decrementing during game play. Also, it can be appreciated that a game apparatus as disclosed in FIG. 4 can be manufactured to incorporate only one of the mechanisms, i.e., either a timer 76 or a counter 78.

Figure 5:
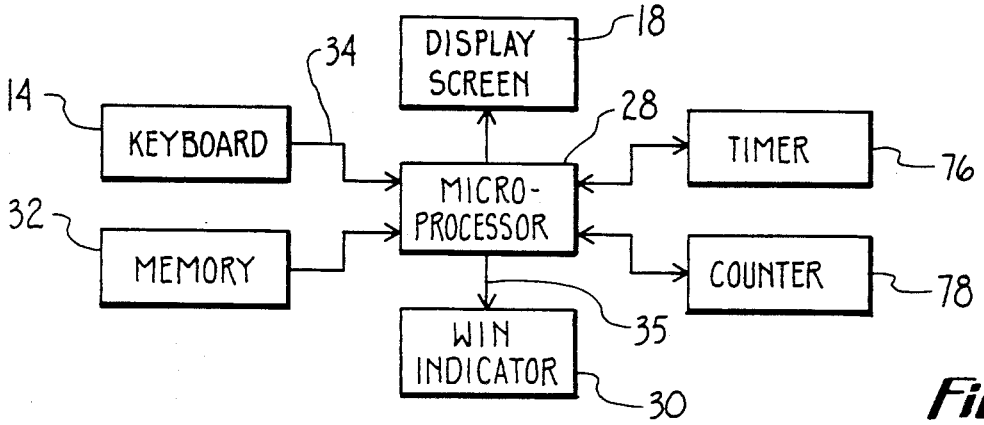
FIG. 5 is a block diagram illustrating the operation of the portable electronic game apparatus of FIG. 4.

Referring now to FIG. 5, there is shown a block diagram of the basic components of the alternative embodiment 74 which includes all of the components of the preferred embodiment plus the timer component 76 and counter component 78. Microprocessor 28 is operatively connected to both components 76 and 78 for initiating the timing or counting sequence and for monitoring the status of the two components to determine if a losing signal needs to be generated.

FIG. 6 depicts the methodology, in flow-chart form, of the alternative embodiment. Specifically, FIG. 6 shows the operation of the system which incorporates the workings of both the timer and the counter. After the player activates the game by pressing "on" button 24, the timer and counter components are cleared and reset to zero as indicated by block 84. The clock 76 and counter 78 components may then be preset to a certain level in block 86. The game will not begin until the start button is pressed as indicated by the "no" path 88 of test block 90, which directs the system flow back to block 86. Once the start button is pressed, however, the game begins, regardless whether the timer or counter has been preset. After leaving test block 90, the system flow follows "yes" path 92 and also follows either path 94 or path 96 in conjunction with path 92.

The operations performed through path 92 are identical to those of the preferred embodiment up to block 98 of FIG. 6. In block 98, the microprocessor matches license plate characters which are identical to any of the permanent thirty-six (36) characters stored in memory. In addition, the counter is decremented or incremented by one number depending on whether the counter was preset. Once out of block 94, the system enters test block 100 to determine if the number of allowable license plate entries has been exceeded. If the counter shows a zero, indicating that the last allowable set of data has just been entered, or if the counter shows anything above a zero, the system continues through "yes" path 102 to the next test block. Thus, if the counter is greater than or equal to zero, and all characters have been matched, the system provides a win signal at block 104. Alternatively, if the counter is negative at test block 100, the system is directed through "no" path 106 to generate a losing signal at block 108.

Depending on whether the timer has been preset determines whether path 94 or 96 is followed concurrently with path 92. If the timer was not preset in block 86, then path 96 is followed which initiates the timer and displays the elapsed time, as indicated by blocks 110 and 112, respectively. However, if a time was preset in block 84, then the system is directed through path 94. In this instance, the specific time period begins to countdown at block 114. The time remaining is then continually reduced and displayed as indicated by block 116. Once the remaining time is displayed, the system enters test block 118 to determine if the time period has ended. If it has not ended, then the system flows via "no" path 120 back to display block 116. This loop between block 116 and test block 118 continues until all characters have been matched and the player wins the game or until the time period is exceeded. Once the time period is exceeded, the system enters block 108 via "yes" path 122. At block 108, a losing signal is generated and subsequently the system enters block 124 which stops any timing operations. Block 124 may also be entered, after a win signal is generated in block 104, to stop the elapsed time from being monitored through path 96.

Thus, the electronic game apparatus of the present invention may be used in a manner heretofore unavailable. The present hand-held game apparatus thus takes advantage of the traffic congestion, and turns it into a fun experience. It may also be appreciated that the game can be played by users who themselves are not inside an automobile, provided they are in a location from which many different license plates can readily be observed.

In situations where license plates are not readily observed, however, or when the player desires a different method of game play, the present invention can still be used in the manner disclosed. Specifically, referring now to FIG. 7, there is shown a deck of playing cards 126 which can be used in conjunction with the electronic apparatus 10. Deck 126 contains a number of individual playing cards 128 which take the place of individual license plates normally observed by the player. Each card 128 represents a specific set of data which can be entered into apparatus 10 by data entry keys 16. Typically, a deck of cards will contain 50 individual cards each having character data 130 which is entered into apparatus 10 after a particular card !28 is drawn by a user. If a game is neither won nor lost after using the entire deck 126, then deck 126 will be reshuffled and game play will continue.

While the particular game as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as defined in the appended claims.

What is claimed is:

1. An electronic game apparatus which comprises:

a keyboard having a plurality of data entry keys and a plurality of function keys;

a screen for displaying alphanumeric information entered into said apparatus by said data entry keys;

a permanent memory matrix comprising character data wherein each character of said matrix corresponds to one of said data entry keys and represents a constant value used for comparison in each game; and a microprocessor for controlling data flow between said memory, said data entry keys, said function keys, and said display, said microprocessor operative in play mode to accept and compare data entered from said data entry keys with said character data stored in said permanent memory matrix to identify and accumulate matches therebetween and provide a win signal when all of said characters in said permanent memory have been matched.

2. An electronic game apparatus as recited in claim 1, wherein said data entry keys include thirty-six (36) alphanumeric keys arranged in four rows and nine columns, said first row comprising the characters "J, 4, B, 6, V, 1, K, U, G; said second row comprising the characters "D, W, E, H, R, L, Y, N, M; said third row comprising the characters "3, S, C, O, T, I, 9, 7, 0; and said fourth row comprising the characters "F, P, A, 5, X, Z, Q, 8, 2".

3. An electronic game apparatus as recited in claim 1, wherein said function keys include on/off, start, enter, and clear keys.

4. An electronic game apparatus as recited in claim 3, wherein said microprocessor is operative in play mode to accept sets of data upon depressing said enter key, said sets of data comprised of up to eight (8) characters, each of said characters displayed on said screen by said microprocessor upon pressing each respective data entry key.

5. An electronic game apparatus as recited in claim 4, further comprising means for monitoring and displaying the number of said sets of data entered by said data entry keys.

6. An electronic game apparatus as recited in claim 5, wherein said microprocessor is operative in play mode to increment and display said number of said data sets entered in response to depressing of said enter key.

7. An electronic game apparatus as recited in claim 4, further comprising means for monitoring the time during game play.

8. An electronic game apparatus as recited in claim 7, wherein said monitoring means includes an electronic clock showing minutes and seconds elapsed from the start of each game and includes a programmable electronic timer showing minutes and seconds remaining in each game, said microprocessor operative in play mode to generate a losing signal when no time is remaining in a game.

9. An electronic game apparatus as recited in claim 4, further comprising an audible alarm associated with said microprocessor for signalling the end of a game.

10. An electronic game apparatus as recited in further comprising a visible alarm associated with said microprocessor for signalling the end of a game.

11. An electronic game apparatus as recited in claim 4, further comprising a set of playing cards, each of said playing cards representing one of said sets of data for entry into said microprocessor.

12. An electronic game apparatus for use by a player in a location from which many motor vehicle license plates can readily be observed, comprising:

a casing having instruction keys and a screen operatively coupled together;

means for entering sets of alphanumeric data into said electronic apparatus;

a microprocessor operatively coupled to said instruction keys having a memory for storing permanent character data, each permanent character of said memory representing a constant value used for comparison with said entered sets of alphanumeric data;

means for comparing each said set of alphanumeric data to said permanent character data to determine which of said permanent character data has been matched by said alphanumeric data;

means responsive to said comparing means for providing a winning signal when all of said permanent character data has been matched by said sets of alphanumeric data.

13. An electronic game apparatus as recited in claim 12, wherein said means for entering sets of alphanumeric data include thirty-six (36) data entry keys arranged in four rows and nine columns, said first row comprising the characters "J, 4, B, 6, V, K, U, G; said second row comprising the characters "D, W, E, H, R, L, Y, N, M; said third row comprising the characters "3, S, C, O, T, I, 9, 7, 0; and said fourth row comprising the characters "F, P, A, 5, X, Z, Q, 8, 2".

14. An electronic game apparatus as recited in claim 12, wherein said instruction keys include on/off, start, enter, and clear keys.

15. An electronic game apparatus as recited in claim 14, wherein said microprocessor is operative in play mode to accept said sets of alphanumeric data upon depressing said enter key, said sets of alphanumeric data comprised of up to eight (8) characters, each of said characters displayed on said screen by said microprocessor.

16. An electronic game apparatus as recited in claim 15, further comprising means for monitoring and displaying the number of said sets of data entered by said entering means.

17. An electronic game apparatus as recited in claim 16, wherein said microprocessor is operative in play mode to increment and display said number of said data sets entered in response to depressing of said enter key.

18. An electronic game apparatus as recited in claim 15, further comprising means for monitoring the time during game play.

19. An electronic game apparatus as recited in claim 18, wherein said monitoring means includes an electronic clock showing minutes and seconds elapsed from the start of each game and includes a programmable electronic timer showing minutes and seconds remaining in each game, said microprocessor operative in play mode to generate a losing signal when no time is remaining in a game.

20. An electronic game apparatus as recited in claim 15, further comprising an audible alarm associated with said microprocessor for signalling the end of a game.

21. An electronic game apparatus as recited in claim 15, further comprising a visible alarm associated with said microprocessor for signalling the end of a game.

* * * * *